US005174064A

United States Patent [19]

Stark

[11] Patent Number: 5,174,064

[45] Date of Patent: Dec. 29, 1992

[54] FRICTIONAL SASH BALANCE AND JAMB LINER

[75] Inventor: Ivan L. Stark, Ada, Mich.

[73] Assignee: Newell Manufacturing Company, Lowell, Mich.

[21] Appl. No.: 846,050

[22] Filed: Mar. 5, 1992

Related U.S. Application Data

[63] Continuation of Ser. No. 717,391, Jun. 19, 1991, Pat. No. 5,117,586.

[51] Int. Cl.[5] ..... E05F 1/00

[52] U.S. Cl. ..... 49/445; 49/429

[58] Field of Search ..... 49/445, 446, 451, 429, 49/430

[56] References Cited

U.S. PATENT DOCUMENTS

| | | | |
|---|---|---|---|
| 3,466,806 | 9/1969 | Teggelaar et al. | 49/445 |
| 3,499,248 | 3/1970 | Baer | 49/446 X |
| 3,788,006 | 1/1974 | Teggelaar et al. | 49/451 X |
| 4,015,367 | 4/1977 | De Bruyn | 49/451 |
| 4,079,549 | 3/1978 | Wood | 49/446 X |
| 4,570,382 | 2/1986 | Suess | 49/445 X |
| 4,571,887 | 2/1986 | Haltof | 49/429 |
| 4,763,447 | 8/1988 | Haltof et al. | 49/445 X |
| 4,779,380 | 10/1988 | Westfall | 49/445 X |
| 5,036,622 | 8/1991 | Stark | 49/445 |
| 5,117,586 | 6/1992 | Stark | 49/445 |

*Primary Examiner*—Philip C. Kannan

*Attorney, Agent, or Firm*—Price, Heneveld, Cooper De Witt & Litton

[57] ABSTRACT

A sash balance apparatus for vertically slidable window installations, in which a friction shoe is disposed in a channel formed by a jamb liner extending along each side of the slidable sash and a connecting member extends between the sash and the friction shoe in a manner such that the weight of the sash when applied to the shoe tends to pivot the latter at least slightly within the jamb liner channel and thereby bring predetermined surfaces of the shoe into frictional contact with corresponding surfaces of the jamb liner channel, preferably including elongated rib-like intermediate walls which extend into the channel from its sides. The channel thus provides a plurality of different longitudinally-extending friction surfaces which may be selectably engaged by the friction shoe as a function of its particular configuration, dimensions, and the degree of tilt introduced by the applied weight of the sash. In a preferred form, the connector extending between the sash and the shoe comprises a rigid member disposed at an acute angle with respect to the shoe and its channel to promote tilting, and in the most preferred form the connector comprises a particularly bent section of metal wire or rod which is press-fitted or otherwise frictionally attached to the shoe. Also, the jamb liner has laterally offset tab portions which provide integral stops for limiting allowable vertical travel of the shoe.

31 Claims, 3 Drawing Sheets

FRICTIONAL SASH BALANCE AND JAMB LINER

This is a continuation of copending application Ser. No. 07/717,391 filed on Jun. 19, 1991, now U.S. Pat. No. 5,117,586.

FIELD OF THE INVENTION

This invention relates to window jamb liner and balance constructions which provide spring-biased positional support for window sash, and more particular to balance structures for such applications which utilize a pivotally-responsive attachment of the sash to the counterbalance tension spring to produce increased frictional resistance to downward window movement.

BACKGROUND OF THE INVENTION

The use of springs, particularly tension springs, to provide a counterbalance force for the vertically moveable sash to double hung windows has long been known. Various techniques have been developed to counterbalance the force generated by the spring with the weight of the windows, such that the sash will remain stationary in any vertical position of the sash if the window is released by the operator in that particular position. This has been accomplished in a number of ways, as disclosed for example in prior U.S. Pat. Nos. 3,788,006, 4,015,367 and 4,570,382, 4,571,887, 4,763,447 and 4,779,380. However, none of these patents have developed a truly simple structure which is capable of being used with sash of a widely-varying range of sizes and weights without impairing the counterbalancing effectiveness of the mechanism such that either the sash is overly difficult to move in at least certain of its possible positions or else it will not reliably remain in position when moved to a position in which the spring is stretched beyond a given point.

In attempting to develop this balance of forces, it is very important that the balance mechanism be kept simple and its cost minimized. If these requirements are not satisfied, the result is a non-competitive product which will not find commercial acceptance. It is also important that the balance system, including the jamb liner and balance, be easy to install and durable in use. This latter is very important when the system is installed in commercial buildings, such as apartments and the like, where use may be frequent and the lack of durability and dependability will result in excessive maintenance problems.

SUMMARY OF THE INVENTION

The present invention provides a simple, inexpensive, yet highly effective means of utilizing the weight of the sash to vary the positional amount of holding pressure applied by the counterbalance structure to the sash support structure. In accordance with the invention, this is accomplished without any need for adjustment either by the installer or by the user, since the construction of the invention is such that it automatically responds to both the weight and the position of the sash. Thus, the degree of movement-resisting friction generated by the balance structure in accordance with this invention automatically increases or decreases in response to the weight of the sash involved. At the same time, the structure is simple, self-contained, and requires no adjustment or special skills on the part of the installer or the user. It also has no moving parts which affect the automatic responsiveness of the system to the size and weight of the sash. Other and further advantages and benefits of the invention will be understood upon consideration of the ensuing specification and attached drawings which depict certain preferred embodiments thereof.

DESCRIPTION OF PREFERRED EMBODIMENTS

Figure 1:
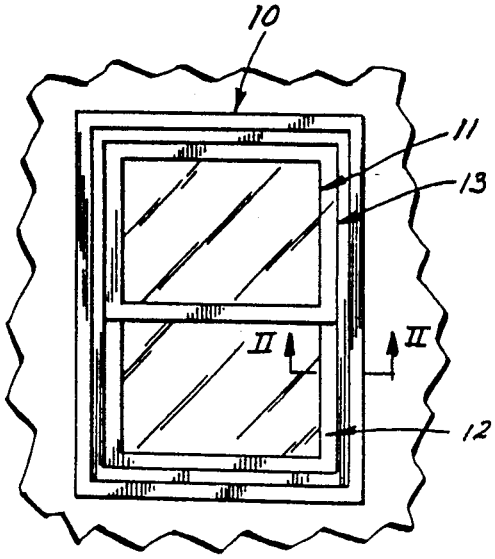
Fig. 1 is a front elevational view of a typical window installation in which the invention can be utilized.
Figure 2:
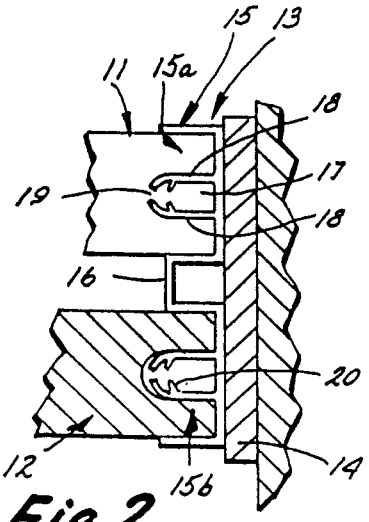
FIG. 2 is an enlarged sectional plan view taken along the plan II—II of FIG. 1.

Referring now in more detail to the drawings, the numeral 10 identifies a double hung window having an upper sash 11 and a lower sash 12. The sash 11 and 12 slide vertically in the guideways (i.e. channels) formed in vertically disposed jambs 13 on each side of the window. An enlarged section through one such jamb is shown in FIG. 2, from which it will be seen that the jambs 13 include a jamb liner 15 comprising an elongated extrusion which is secured to the jamb support 14 by suitable means such as nails or staples (not shown). The jamb liners 15 define a pair of adjacent guideways or channels 15*a*, 15*b*, one for each sash, separated by a mullion 16. Each of the guideways or channels 15*a*, 15*b* has a central guide structure 17 formed by projecting walls 18 whose outer ends or channels may curve toward each other to define a central slot 19 as shown in FIGS. 2 and 5.

Figure 3:
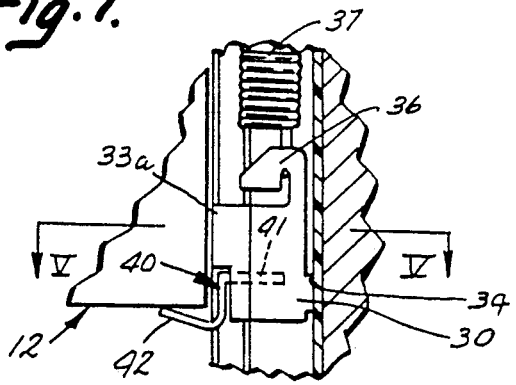
FIG. 3 is a further enlarged fragmentary sectional side elevational view of the sash-supporting and cooperating balance structure components, illustrating a first construction.
Figure 5:
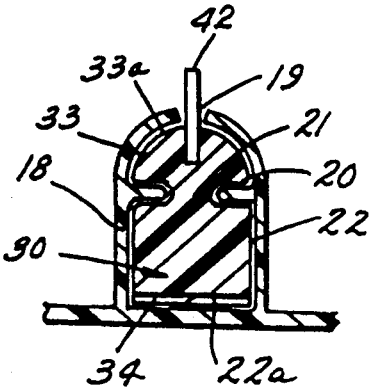
FIG. 5 is an enlarged fragementary sectional plan view taken along the plane V—V of FIG. 3.

Inwardly of the central slot 19, the walls 18 have flanges or ribs 20 which extend toward each other and define an inner or second slot 21 between them (FIG. 5). Between the flanges 20 and the base of the channel is a generally rectangular opening 22 extending the length of the jamb, along which the sash-supporting shoe 30 slides (FIG. 3). The flanges 20 may be generally parallel to the base of the channel (FIG. 5) or they may be inclined to the side walls as shown in FIG. 2. The jamb liners 15 are preferably extrusions of a suitable plastic material such as polyvinyl chloride.

Figure 6:
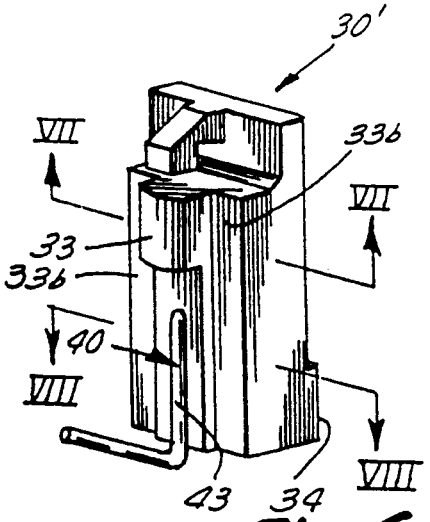
FIG. 6 is a frontal perspective view of the sash-support shoe shown in FIG. 5.
Figure 9:
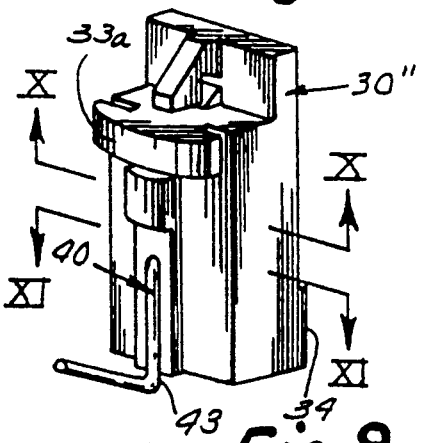
FIG. 9 is a perspective view similar to FIG. 6 but illustrating a modified construction for the shoe.
Figure 12:
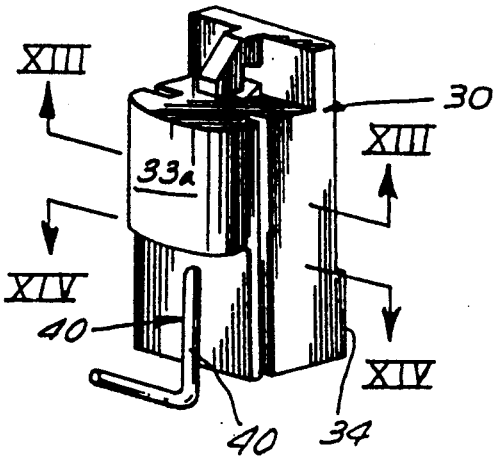
FIG. 12 is a perspective view similar to FIG. 6 illustrating a further modification of the shoe.
Figure 18:
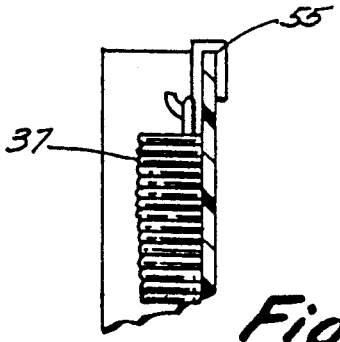
FIG. 18 is a fragmentary sectional side elevation view of the anchor which secures one end of the sash-supporting tension spring to the sash guide channel.
Figure 16:
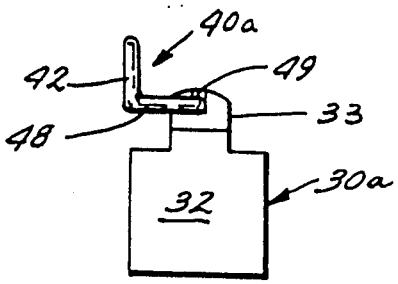
FIG. 16 is a bottom plan view of the shoe shown in FIG. 15, showing modified construction for the sash-engaging finger.
Figure 15:
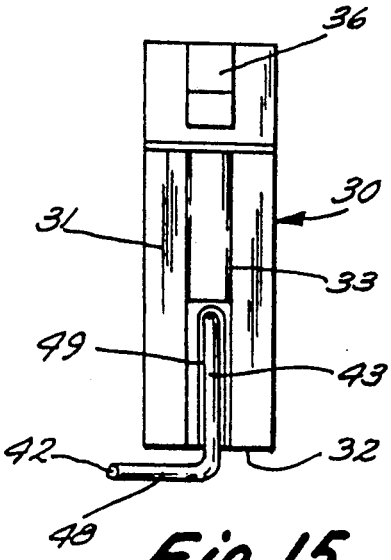
FIG. 15 is a front elevation view of the shoe shown in FIG. 6.

The sash-supporting shoe 30, as shown in FIGS. 3, 5 and 12, and its varying embodiments 30', 30'' shown in FIGS. 6, 9, and 15 (sometimes all generically referred to by the common numeral 30), has an elongated body 31, the base portion of 32 of which is shaped and cross-sectionally sized to closely but slidably fit inside the opening 22. The shoe 30 also has a rib 33 which projects outwardly through at least the inner slot 21. The upper end of shoe 30 has an integral hook 36 for securing the shoe to a spring 37 whose upper end is anchored to the top of the jamb liner (FIG. 18), as for example by use of an s-shaped clip or hook 35. The integral hook 36 at the top of shoe 30 is so shaped that the end of spring 37 attached to the shoe engages the shoe at a point offset laterally toward the base of the guideway (FIG. 3).

Figure 17:
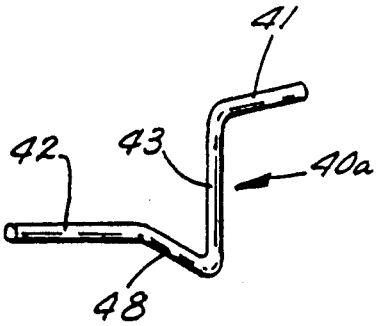
FIG. 17 is an oblique view of the finger illustrated in FIG. 16.

The shoe 30 is provided with a somewhat z-shaped sash-engagement hook 40, 40*a* (FIGS. 3 and 17 respectively), one leg 41 of which is press-fitted into an opening in the front of the shoe 30, thereby securing the hook to the shoe. The opposite end of hook 40 is formed into a sash-engaging leg or foot 42 which is joined to the first leg 41 by an intermediate portion 43. The lower intermediate portion 43 is designed to lie along and generally parallel to the lower front surface of shoe 30, below rib 33, preferably in flush contact therewith, although this is not strictly necessary.

The foot or second leg 42 of sash support 40 projects under the sash, and is preferably inclined upwardly at a minor angle (FIG. 3) such that the end extremity of leg 42 is the part which actually makes contact with the bottom of the sash. This configuration produces a force vector, in response to the weight of the sash, which generates a pivotal moment about intermediate portion 43, between legs 41 and 42. This moment applies a rotational force to the shoe 30 which cocks it within the area 22 and increases the pressure which the shoe applies to the channel in which it is disposed, as discussed further hereinafter. Because of the angular inclination of the second leg 42 and the resulting location of the contact point between it and the sash, the force applied to the shoe is multiplied by the length of the second leg 42; or course, this effect is also, in part, a function of the weight of the window, since this determines the magnitude of the force applied to the end of leg 42. This is important, because it results in an automatic compensation means for adjusting the braking response of the system to the weight of the sash, thereby providing an automatic brake against inadvertent or unwanted vertical movement or the sash.

The braking force generated by the shoe 30 in response to the weight of the sash is frictional in nature, and may be selectably produced at several different points in accordance with the concepts underlying the invention. First, in the embodiment shown in FIGS. 3, 5 and 12, and to some extent that shown in FIG. 9, substantial braking forces may be generated by engaging both of the opposite sides (i.e., front and rear) of the flanges 20 with the corresponding sides of the recesses in shoe 30 which receive the flanges 20. This is accomplished by cocking the shoe element 30 within channel 17 in response to the weight of the window sash. Depending upon the various parameters of the window involved, the friction so produced may well be sufficient to properly balance (i.e., position) any given sash; however, the novel balance structure in accordance herewith lends itself to substantial additional force generation, and to variation of the frictional response resulting, by the overall configuration presented.

That is, the shoe 30 provides other and further sources of frictional braking force which may be utilized in selected combinations to accommodate varying situations encountered. One such attribute and feature is provided by a pad 34 which is disposed for sliding contact with base 22*a* of the area 22 (FIG. 5) and located adjacent the lower end of the shoe, remote from the hook 36. The vertical length of pad 34 is preferably approximately equal to that of the intermediate portion 43 of hook 40. In the absence of pad 34, the weight of the sash tends to pivot shoe 30 about the corner thereof opposite hook 36, with a resultant force component directed toward base 22*a*. The pad 34 thus provides a fulcrum which permits the lateral offset of spring 37, away from the side of the sash and the pivot axis of shoe 30, to counter the moment applied through the finger 42. In addition, substantially the entire rear surface of pad 34 may be disposed to bear against the base 22*a* in a manner generating substantial frictional braking force where this is necessary or desirable. Thus, practically the entire surface of pad 34 may define a frictional area for materially increasing the effectiveness of the shoe in resisting sliding downward movement along the jamb channel.

In addition to the frictional braking surfaces noted above, it may also be observed that the rounded front surface 33*a* of the rib 33 on shoe 30 (FIGS. 3, 5, 9 and 12) may be sized and configured in a manner to produce frictional braking force by riding upon the inside surfaces of the curved forward extremities of legs 18, on each side of the opening 19 therebetween, although this will not normally be necessary or desirable in view of the amount of force which can be generated by the other surfaces, as noted above, and in further view of the fact that these forward portions of legs 18 are likely to be comparatively flexible in nature and not sufficiently rigid to generate extensive braking force in any event. Indeed, as exemplified by the embodiment of the shoe 30' shown in FIG. 6, the entire rib 33 may be made relatively narrow, such that it merely projects forward between the interior flanges or ribs 20 and primarily functions as a guide which helps stabilize the position of the shoe within the channel as it moves up and down.

In addition, the embodiment 30' of the shoe actually omits the side grooves found in the other embodiments which receive the projecting flanges 20 and which may be utilized to generate frictional braking forces by engaging both the front and rear surfaces of, these flanges. Thus, the embodiment of the shoe 30' merely includes a pair of spaced, generally parallel, elongated shoulders 33*b*, which in effect constitute only the back half of the groove found in the other embodiments. The configuration of the shoe 30' generates braking forces merely by cocking within the channel so as to bring the upper portions of shoulders 33*b* into contact with the rear surfaces of projecting flanges 20 while at the same time bringing the support pad 34 at the bottom of the rear surface of the shoe into frictional contact with the surface 22*a* of the channel. Notwithstanding the evident reduced amount of frictional surface used in this embodiment, it nonetheless provides very satisfactory results in many instances, and may in fact be considered the preferred embodiment, and best mode of practicing the invention.

Figure 4:
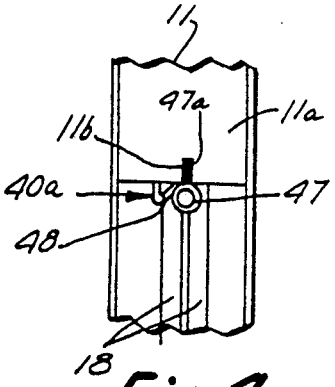
FIG. 4 is a fragmentary front elevational view of the structure shown in FIG. 3.

To make the windows more effective as a draft barrier, it is desirable to add a flexible weather seal 47 (FIG. 4) along the bottom (FIGS. 4 and 17) rail 11*a* of the sash, typically by securing an attachment flange 47*a* of the weather seal within a slot 116 extending across the bottom of sash style 11*a*. In order to accommodate this effectively and with the best overall result, the embodiment 40*a* of the sash support hook is formed with an offset 48 between the lower end of the intermediate portion 43 and the second leg 42 (FIGS. 4, 15, 16 and 17). This offset locates the second leg to one side of the weather seal 47 (FIG. 4). The second leg 42 in this 40*a* of the sash support is inclined upwardly in the same manner as the leg 42 for the support 40 described previously (FIGS. 15 and 17). However, due to the offset 48, a moment is created about the extending leg 41 secured to the shoe 30. Because the offset 48 is short, the moment is small and in most cases is prevented from pivoting the support 40*a* around leg 41 as an axis because the end of the second leg 42 will become slightly embedded in the wood of the sash style during actual use. However, should it be desirable to positively prevent pivotal movement of the sash support 40*a* about its attachment leg, the shoe 30 can be made with a slot-like recess 49 for seating the intermediate portion 43 (FIGS. 15 and 16) to prevent this.

Figure 19:
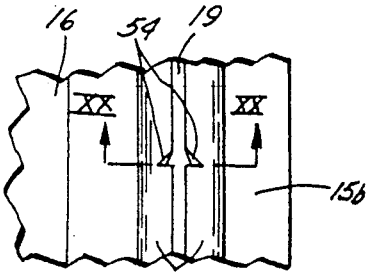
FIG. 19 is a fragmentary front elevational view of a portion of the channel showing a preferred stop structure for the shoe.
Figure 20:
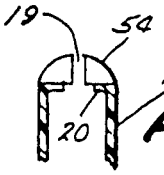
FIG. 20 is a fragmentary sectional plan view taken along the plane XX—XX of FIG. 19.

To act as a sash stop and prevent excess upward movement of the sash and associated balance devices, a stop means can be provided in accordance with the invention by nicking (i.e. lancing) the channel 17 with an appropriately configured die or other such tool and bending the resulting cut edges inwardly toward each other to form tabs 54, as shown in FIG. 19. This is very useful during shipping and subsequent installation of the window assembly, since the jamb liners and sash must be assembled prior to mounting in the window opening and inserted into the latter as a unit. This is necessary since the jamb liners are both extrusions in which the guideways 15, mullion 16 and channels 17 are all formed as a single, integral part. Thus, once a pair of jamb liners is secured to the window jambs 14 with a sash 11 or 12 in place between them, the individual sash cannot be removed. It is also necessary that the upper ends of the springs 37 be anchored to the vertical tracks, but this may be accomplished by any suitable means such as clips 55 (FIG. 18) which hook over the back of guideways.

Figure 22:
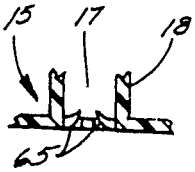
FIG. 22 is a fragmentary sectional view taken along the plane XXII—XXII of FIG. 21.
Figure 21:
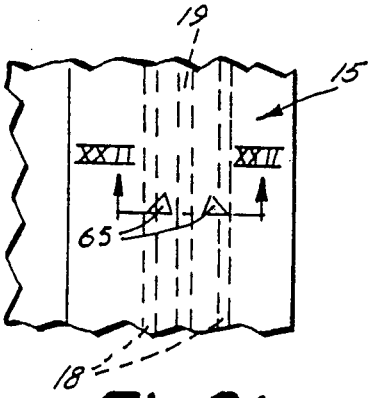
FIG. 21 is a fragmentary rear elevational view of a portion of the channel showing another embodiment of a stop structure for the shoe.
Figure 7:
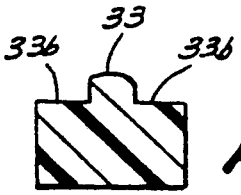
FIG. 7 is a sectional view taken along the plane VII—VII of FIG. 6.
Figure 8:
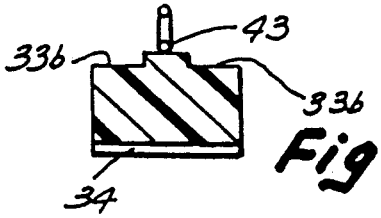
FIG. 8 is a sectional view taken along the plane VIII—VIII of FIG. 6.
Figure 10:
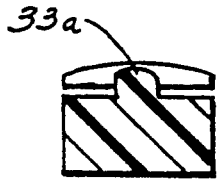
FIG. 10 is a sectional view taken along the plane X—X of FIG. 9.
Figure 11:
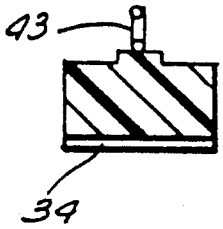
FIG. 11 is a sectional view taken along the plane XI—XI of FIG. 9.
Figure 13:
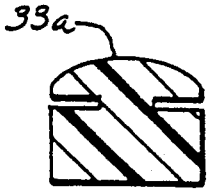
FIG. 13 is a sectional view taken along the plane XIII—XIII of FIG. 12.
Figure 14:
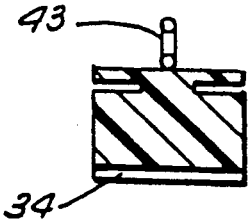
FIG. 14 is a sectional view taken along the plane XIV—XIV of FIG. 12.

FIGS. 21 and 22 illustrate a different way of implementing the concept noted above for providing integral stops to limit travel of the sash support shoe. In this case, the base of the jamb liner 15 is nicked or lanced, from the side opposite legs 18, and in the area between the latter to form a pair of ears 65 which are turned inwardly into the area 17 to provide an abutment which will limit vertical travel of the shoe.

It will be recognized that the invention provides an inexpensive, simple and functionally effective means for counterbalancing vertically slidable window sash. At the same time, it provides a system suitable for window sash of a substantial range of sizes and weights which is capable of automatically adjusting to the particular sash weight so that the window is easy to open and close yet positively held stationary in any desired position of adjustment.

Having described the preferred embodiment of the invention and various aspects of its application, it will be understood that modifications of the invention can be made without departing from its principles. Such modifications are to be considered as included in the hereinafter appended claims unless the language of the claims expressly states otherwise.

The embodiments of the invention in which an exclusive property or privilege is claimed are defined as follows.

1. Means for balancing a vertically movable window sash slidably mounted between a pair of vertical guides, each such guide having wall portions forming a pair of oppositely disposed friction braking surfaces extending vertically with said guides, a frictional braking shoe disposed between said braking surfaces and having a cross-sectional shape and size to be slidably received therebetween, a tension spring having an upper end secured with respect to said guide and a lower end secured to said show, and a sash support member comprising a rigid one-piece unitary lever element having a pair of mutually spaced arm portions, one of said arm portions extending toward and into secured engagement with said shoe and the other of said arm portions projecting toward said sash to seat under at least portions thereof and couple the sash to said spring for support thereupon, said sash support member being configured and engaged with said shoe such that the weight of said sash acting on said other arm portion of said sash support member acts through said sash support member as a unitary lever to rotatably move said shoe against said braking surfaces with sufficient pressure to frictionally hold said sash in position in a plurality of different vertical positions along said guides against the operative influence of the spring at any such different vertical positions.

2. The means for balancing a vertically slidable window sash as set forth in claim 1, wherein said wall portions comprise a pair of flanges extending generally toward each other and terminating in spaced relation to define a passage therebetween, said shoe having lengthwise-extending shoulders adapted to slidably engage said flanges and thereby generate frictional sash-positioning forces when said shoe is rotatably moved by the weight of a sash acting on said other end portion of said sash support member.

3. The means for balancing a vertically slidable window sash as set forth in claim 2, wherein said shoe includes a pair of lengthwise-extending slit-like recesses defining said shoulders, each such recess adapted to receive an opposite one of said flanges.

4. The means for balancing a vertically slidable window sash as set forth in claim 3, wherein said recesses are formed by a pair of mutually-spaced walls adapted to engage opposite sides of said flanges to generate said positioning forces.

5. The means for balancing a vertically slidable window sash as set forth in claim 1, wherein said shoe has a friction pad area adjacent its lower end extending toward one of said braking surfaces to form a fulcrum about which said shoe rotates under the weight of the sash, said pad area having a friction surface adapted to slidably engage said braking surfaces to generate sash-positioning frictional forces which resist movement of the shoe lengthwise of said guides.

6. The means for balancing a vertically slidable window sash as set forth in claim 5, wherein said sash support member includes portions which extend generally vertically and said other arm portion of said sash support member is disposed below said one arm portion thereof.

7. The means for balancing a vertically slidable window sash as set forth in claim 5, wherein said tension spring engages said shoe at a point which is intermediate the sides of said shoe and offset laterally from the sash, whereby the weight of the sash acting on said sash support member rotates the shoe into a position such that said friction surface of said pad engages said friction braking surfaces to increase the frictional resistance to shoe movement and stabilize the vertical position of the sash.

8. Means for positionally supporting a vertically slidable window sash, said means being adapted to be mounted along the vertical side of said window, said means including an elongated track along which the edge portion of said sash is slidable, said track having a pair of walls defining a channel therebetween, a sash-positioning shoe disposed at least partially within said channel, and a generally rigid sash support secured to said shoe, said sash support having a first portion which extends generally parallel to said elongated track and having a second portion which extends angularly away from said first portion and into engagement with said sash, said sash support comprising an integral shoe-rocking means for rocking said shoe into increasing frictional engagement with the walls of said channel in response to the particular weight of a sash acting on said rocking means to thereby resist movement of said sash along said track and at least partially support said sash in various selected vertical positions along said track.

9. Means for supporting a vertically slidable window sash as set forth in claim 8, wherein said first portion of said generally rigid sash support extends downwardly and lengthwise of said shoe, whereby said first portion is generally disposed at least partially above said second portion.

10. Means for supporting a vertically slidable window sash as set forth in claim 9, wherein said sash support comprises a one-piece member.

11. Means for supporting a vertically slidable window sash as set forth in claim 9, wherein said shoe includes a recess sized and shaped to receive at least part of said first portion of said sash support, said shoe being secured to said sash support by the engagement of said part received within said recess.

12. Means for supporting a vertically slidable window sash as set forth in claim 8, wherein said sash support comprises an angularly-configured rod-like member.

13. Means for supporting a vertically slidable window sash as set forth in claim 8, wherein said second portion of said sash support comprises a leg which is offset laterally from said first portion thereof and said leg engages said sash at a location offset from the central plane of the sash.

14. Means for supporting a vertically slidable window sash as set forth in claim 8, wherein said second portion of said sash support comprises a leg which extends toward said sash at an acute angle with respect thereto from below its place of contact therewith to engage said sash at a location along said leg which is spaced laterally from said shoe, to apply a moment arm thereto for rocking said shoe.

15. Means for supporting a vertically slidable window sash as set forth in claim 14, wherein said shoe includes a recess sized and shaped to receive at least portions of said leg of said sash support in close frictional engagement.

16. In an apparatus for balancing a vertically movable window sash slidably mounted between a pair of vertical guides having wall portions forming mutually spaced friction braking surfaces extending vertically with said guides, wherein a frictional braking shoe is disposed between said braking surfaces and has a cross-sectional shape and size to be closely but slidably received therebetween and a tension spring extends along said guide and has an upper end secured with respect to said guide and a lower end secured to said shoe, the improvement comprising: a sash support member comprising a rigid one-piece unitary lever element having a pair of spaced end portions, one of said end portions extending toward said shoe for securement thereto and the other of said end portions projecting toward said sash to seat under at least portions thereof and support the sash upon said spring, said sash support member and said shoe being configured for mutual engagement such that the weight of said sash acting on said other end portion of said sash support member causes said sash support member to act as a unitary lever which rotatably moves said shoe against at least certain of said braking surfaces and applies pressure thereto for frictionally holding said sash in a plurality of different vertical positions along said guides.

17. The improvement recited in claim 16, wherein said shoe includes means defining a recess for receiving at least said one end portion of said sash support member, said one end portion coupling said shoe to said sash support member.

18. The improvement recited in claim 17, wherein said recess-defining portions of said shoe and said one end portion of said sash support member transmit the forces which rotatably move shoe by the weight of a sash acting on said other end portion of said sash support member.

19. The improvement recited in claim 18, wherein said recess comprises an elongated aperture having a cross section of a size and shape complementary to that of said sash support member one end portion.

20. The improvement recited in claim 19, wherein said shoe aperture and said one end portion of said sash support have a close friction fit.

21. The improvement recited in claim 19, wherein said one end portion of said sash support has a generally circular cylindrical cross section and is received by said shoe aperture for at least limited relative rotation therebetween.

22. Means for balancing a vertically movable window sash slidably mounted between a pair of vertical guides, each such guide having projecting wall portions forming a pair of oppositely disposed, mutually spaced ribs providing friction braking surfaces which extend vertically with said guides, a frictional braking shoe having portions extending between said spaced ribs and having at least two sets of mutually spaced braking elements, each adapted to slidably receive a different one of said ribs therebetween, a tension spring having an upper end secured with respect to said guide and a lower end secured to said shoe. and a sash support member having first portions extending toward and secured to said shoe and second portions projecting toward and engaging said sash to couple the sash to said spring for support thereupon, said sash support member being configured and secured to said shoe such that the weight of said sash acting on said other arm portion of said sash support member acts through said sash support member to move said braking elements of said shoe against said braking surfaces with sufficient pressure to frictionally hold said sash in position in a plurality of different vertical positions along said guides against the operative influence of the spring at any such different vertical positions.

23. The means for balancing a vertically slidable window sash as set forth in claim 22, wherein said ribs comprise a pair of flanges extending generally toward each other and terminating in spaced relation to define a passage therebetween, said shoe having lengthwise-extending shoulders adapted to slidably engage said flanges on each opposite side thereof and thereby generate frictional sash-positioning forces when said shoe is moved by the weight of a sash acting on said sash support member.

24. The means for balancing a vertically slidable window sash as set forth in claim 23, wherein said shoe includes a pair of lengthwise-extending slit-like recesses defining said braking elements, each such recess adapted to receive an opposite one of said flanges.

25. The means for balancing a vertically slidable window sash as set forth in claim 24, wherein said flanges comprise generally rigid wall sections of said guides.

26. The means for balancing a vertically slidable window sash as set forth in claim 22, wherein said shoe and said sash support member are configured so that said shoe is cocked into frictional engagement with said frictional braking surfaces by acting through said sash support member.

27. Means for positionally supporting a vertically slidable window sash, said means being adapted to be mounted along the vertical side of said window, said means including an elongated track along which the edge portion of said sash is slidable, said track having walls defining a channel including a pair of mutually spaced front walls defining a slot therebetween and a rear wall, said front and rear walls defining at least a pair of spaced frictional braking surfaces or at least one side thereof, a sash-positioning shoe disposed at least partially between said front and rear walls, and a sash support secured to said shoe and having portion which extends generally away from said shoe and into engagement with said sash, said sash support comprising means for rocking said shoe into increasing frictional engagement with at least a selected pair of said frictional braking surfaces in response to the weight of a sash acting on said sash support to thereby resist movement of said sash along said track and at least partially support said sash in various selected vertical positions along said track.

28. Means for supporting a vertically slidable window sash as set forth in claim 27, wherein said spaced front walls each define braking surfaces on each opposite side thereof, and said selected pair of braking surfaces include at least one of the said braking surfaces on each of said spaced front walls.

29. Means for supporting a vertically slidable window sash as set forth in claim 28, wherein said selected pair of braking surfaces include at least the said braking surfaces of rear wall.

30. Means for supporting a vertically slidable window sash as set forth in claim 28, wherein said selected pair of braking surfaces include the braking surfaces on each opposite side of each of said spaced front walls.

31. Means for supporting a vertically slidable window sash as set forth in claim 30, wherein said selected pair of braking surfaces include at least the said braking surfaces of rear wall.

* * * * *